US006722513B1

(12) United States Patent
Flood et al.

(10) Patent No.: US 6,722,513 B1
(45) Date of Patent: Apr. 20, 2004

(54) INFANT AND TODDLER DRINKING CONTAINERS WITH CHILD RESISTANT CAPS

(76) Inventors: Dennis Flood, 163 New Hwy., Commack, NY (US) 11725; Jocelyn Flood, 163 New Hwy., Commack, NY (US) 11725

( * ) Notice: Subject to any disclaimer, the term of this patent is extended or adjusted under 35 U.S.C. 154(b) by 0 days.

(21) Appl. No.: 09/655,016

(22) Filed: Sep. 5, 2000

(51) Int. Cl.[7] ..... A47G 19/22

(52) U.S. Cl. ..... 215/11.1; 215/11.6; 215/220; 215/276; 220/717

(58) Field of Search ..... 215/11.1, 11.6, 215/216, 217, 219, 220, 274, 276, 330; 220/703, 716, 717, 288, 319

(56) References Cited

U.S. PATENT DOCUMENTS 2,834,496 A * 5/1958 Boston et al. ..... 215/11.1
3,472,411 A * 10/1969 Turner ..... 215/220
3,530,979 A * 9/1970 Merrill Jr. et al. ..... 215/11.1
3,782,604 A * 1/1974 Kessler
3,853,236 A * 12/1974 Ostrowsky ..... 215/220
4,284,201 A * 8/1981 Nixon ..... 215/220
4,286,633 A * 9/1981 Herr ..... 215/220
4,850,496 A * 7/1989 Rudell et al. ..... 215/11.1
5,316,161 A * 5/1994 Gargione ..... 215/220
5,878,898 A * 3/1999 Shefflin ..... 215/11.6

FOREIGN PATENT DOCUMENTS

DE 2358128 * 1/1975

* cited by examiner

*Primary Examiner*—Nathan J. Newhouse
(74) *Attorney, Agent, or Firm*—Alfred M. Walker

(57) ABSTRACT

A child-resistant closure prevents a toddler or other young child from unscrewing the top off from a beverage container, such as a milk bottle or covered sipping cup, and spilling its contents on furniture or other inappropriate locations. The child-resistant closure prevents ugly staining of clothes or furniture by difficult to wash beverages, such as grape juice. The child-resistant closure for a beverage container includes an inner screw cap which is threadably mountable on the beverage container, such as the milk bottle with a nipple or the sipping cup. An outer operating ring cap is mounted on the inner cap. The outer operating ring cap has a circumferential retaining rim on a lower end thereof to retain the inner cap within the outer cap.

6 Claims, 3 Drawing Sheets

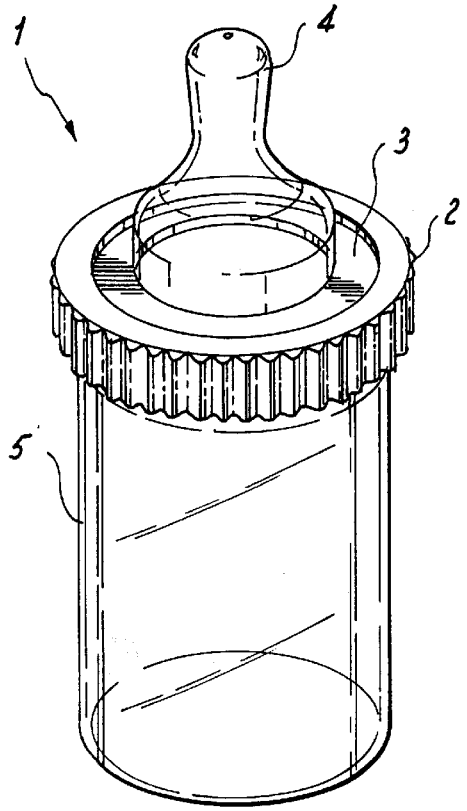
Fig. 1
Fig. 2
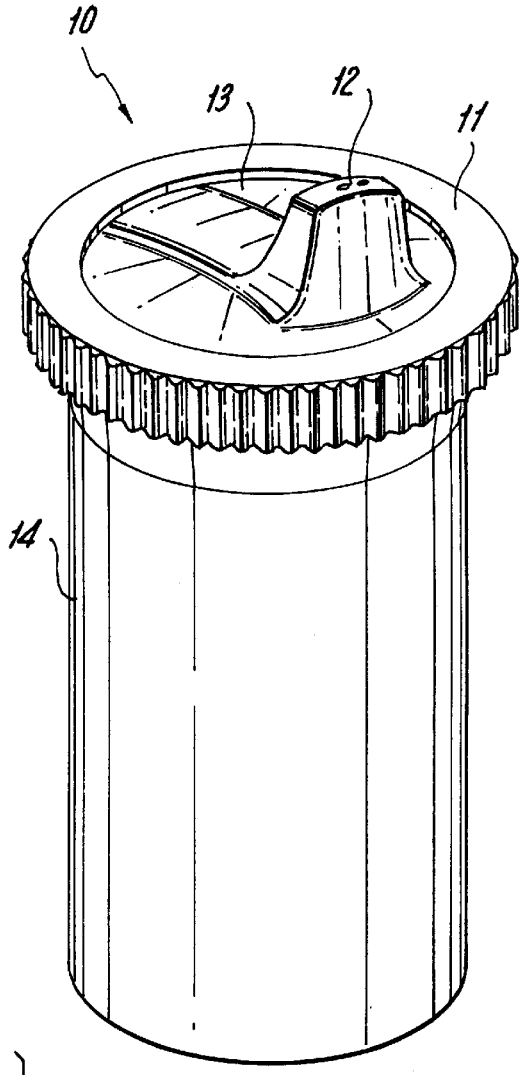
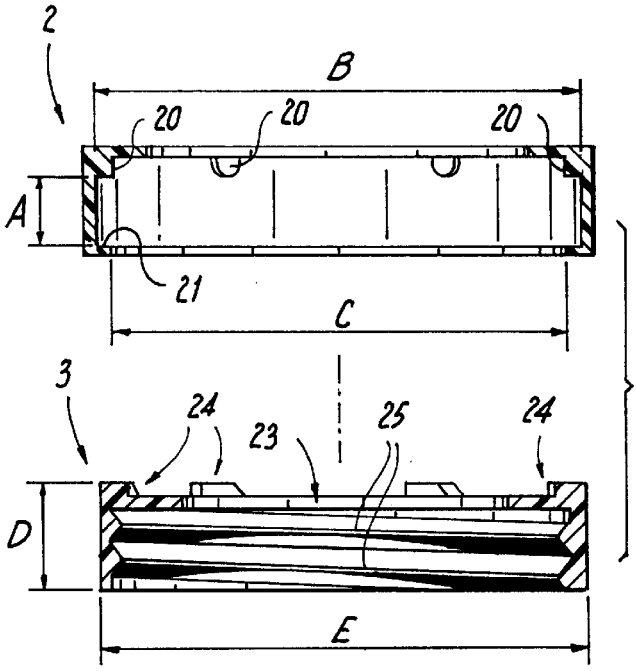
Fig. 3

INFANT AND TODDLER DRINKING CONTAINERS WITH CHILD RESISTANT CAPS

FIELD OF THE INVENTION

The present invention relates to a child resistant cap for baby bottles and toddler sipping cups.

BACKGROUND OF THE INVENTION

A common innocent nuisance caused by toddlers or young children is when they unscrew the nipple caps from their baby bottles or the tops from their closed sipping cups, thereby spilling the beverage contents. The spilled milk causes unpleasant odors to accumulate on clothes and furniture. In addition, juices, such as grape juice, stain easily and are difficult to remove.

Unfortunately, most baby bottles and sipping cups can be loosened and screwed by even a small child's manipulation. Moreover, most are loosened initially, to let air in to facilitate sucking of the beverage through the nipple.

Child resistant caps are known, but mainly in the medicine container field to prevent access to the potentially harmful contents therein.

For example, U.S. Pat. No. 5,529,202 of Shamis describes a child's drinking cup that has a forced-upward cap that needs a latch to be disengaged to be unscrewed off U.S. Pat. No. 5,893,473 of Morris recognizes a child resistant closure for a medicine container where the cap is freely rotatable and spins, unless downward pressure is applied to unscrew the cap. U.S. Pat. No. 5,918,752 of Meyer describes that a cap which is also freely rotatable unless downward pressure is applied.

U.S. Pat. No. Des. 364,316 of Humphrey describes a covered sipping cup in general. U.S. Pat. No. 3,885,712 of Libit, U.S. Pat. No. 4,144,983 of Pauls, U.S. Pat. No. 4,345,691 of Burke U.S. Pat. No. 4,358,031 of Lohrman U.S. Pat. No. 4,846,599 of Seddon, U.S. Pat. No. 5,143,237 of Lindsey, U.S. Pat. No. 5,154,702 of Fogil, U.S. Pat. No. 5,360,127 of Barriac and U.S. Pat. No. 5,685,445 of Dobbs all describe locking caps which use locking tabs that must be disengaged by force before the caps can be opened.

Furthermore, U.S. Pat. No. 4,850,496 of Rudell, U.S. Pat. No. 5,147,066 of Snider, U.S. Pat. No. 5,960,987 of Solland and U.S. Pat. No. 6,053,342 of Chomik describe children's drinking cups with various types of locking caps.

U.S. Pat. No. 5,417,563 of Cirami describes a cigarette lighter with a cap that moves rotationally and downward to operate. U.S. Pat. No. 5,819,965 of King describes a medicine cap ring which requires rotation and downward pressure to open.

U.S. Pat. No. 5,988,413 of Nagel describes a toothpaste tube that has a cup that needs downward pressure to rotate and unthread.

U.S. Pat. No. 5,285,917 of Hoffman and U.S. Pat. No. 5,509,550 of Dejonge describe caps with latches that must be moved to unscrew the cups.

U.S. Pat. No. 4,387,817 of Wiles, U.S. Pat. No. 5,476,181 of Seidler and U.S. Pat. No. 4,319,690 of Birrell all require downward pressure to open the caps.

However, these caps of the prior art do not describe a convenient screw-off type of cap, with a sanitary cover, for a child's beverage container, such as a nippled bottle or sipping cup, that can only be opened by adult manipulation.

OBJECTS OF THE INVENTION

It is therefore an object of the present invention to provide a child resistant cap for baby bottles and toddler sipping cups.

It is also an object of the present invention to prevent toddlers or young children from unscrewing the nipple caps from their baby bottles or the tops from their closed sipping cups, thereby spilling the beverage contents.

It is yet another object of the present invention to prevent unpleasant odors and difficult to remove stains from accumulating on clothes and furniture.

It is also an object of the present invention to provide a tightenable closure for a cap for a child's beverage container.

It is further an object of the present invention to permit free rotation of an outer operating ring cap in the screw-off direction about an inner screw cap, without substantial user compressive force.

It is yet still another object of the present invention to provide a user-removable sanitary protection cap which is removably mounted upon a child-proof beverage container cup at a sufficient height and volume therewithin to accommodate a mounted-in-place baby bottle nipple in a sanitary position therein.

It is also an object of the present invention to provide an aftermarket childproof beverage container cap which can be easily designed to mate with standard threads used by a number of manufacturers of popular brands of baby bottles.

It is additionally an object of the present invention to provide a childproof beverage container cap which has a significant frictional counter-torque that is generated proportional to the downward force exerted thereon.

It is yet another object of the present invention to improve over the disadvantages of the prior art.

SUMMARY OF THE INVENTION

In keeping with these objects and others which may become apparent, the present invention includes a child-resistant closure that prevents a toddler or other young child from unscrewing the top off from a beverage container, such as a nippled milk bottle or a covered sipping cup, and spilling its contents on furniture or other inappropriate locations. The childproof beverage container cap prevents ugly staining of clothes or furniture by difficult to wash beverages, such as grape juice.

Structurally, the child-resistant closure for the beverage container includes an inner screw cap which is threadably mountable on the beverage container, such as the milk bottle with a nipple, or upon the sipping cup. An outer operating ring cap is mounted on the inner cap. The outer operating ring cap has a circumferential retaining rim on a lower end thereof to retain the inner cap within the outer cap.

For tightened closure of the outer operating ring cap with the inner cap, the outer operating ring cap has a plurality of downwardly-projecting nibs disposed on an inside top surface thereof.

The inner screw cap has a circumferential engagement ring on an upper surface thereof, wherein the engagement ring of this inner screw cap has a top surface and a plurality of radially disposed ramped notches therein. These ramped notches each respectively have a depressed floor, a vertical boundary wall running between the depressed floor and the top surface on one side of the notch, and a ramp running between the floor and the top surface on another side of the notch.

The downwardly extending nibs of the outer operating ring cap engage the ramped notches of the inner screw cap in a ratchet fashion, to permit tightening of the inner screw cap when these nibs engage the vertical boundary wall of the inner screw cap, as the outer operating ring cap rotates in the screw-on direction. These nibs also to permit free rotation of the outer operating ring cap in the screw-off direction about the inner screw cap, when the nibs engage the ramp, without substantial user compressive force, such as when small child tries to manually rotate the cap.

In contrast to a child's efforts to twist the cap, when the nibs engage the ramps, they permit effective screw-off torque contact between the nibs of the outer operating ring cap and the ramps of the inner screw cap, but only if there is sufficient adult-user compressive force being applied to the outer operating ring cap, while the cap is turned in the screw-off direction.

This simultaneous compressive force and screw-off turning effects the screw-off loosening of the inner screw cap from its threaded engagement on a beverage container, such as a milk bottle with a nipple or a covered sipping cup.

The circumferential retaining rim of the outer operating ring grasps the inner screw cap, upon this adultuser application of upward force, while the adult turns the cap in the screw-off direction subsequent to screw-off loosening of the inner screw cap. This grasping of the loosened inner screw cap by the retaining rim provides for relatively effortless and convenient adult-user unscrewing of the inner screw cap, for re-filling the beverages container, such as the nippled milk bottle or covered sipping cup.

The present invention therefore provides a method of preventing a child from opening a beverage container, and spilling the contents therefrom. In operation, the adult user first fills a child's drinking container with a beverage and screws on the aforementioned child resistant closure cap. The adult removes this closure, when the child has finished with the beverage, by applying compressive force to the closure and by applying torque in the screw-off direction to the closure, while applying this compressive force to loosen the threaded mounting of the inner screw cap to the beverage container.

When the adult user ceases the compressive force, the adult user applies an upward pulling force to the outer operating ring cap and resumes applying of torque in the screw-off direction, while maintaining an upward pulling force so as to maintain circumferential retaining rim in a grasping contact with the inner screw cap, until the inner screw cap has been completely unscrewed from the beverage container to which it had been mounted.

The child resistant closure is threadably mounted on beverage containers such as standard-thread baby bottles, wherein the inner screw cap has a central aperture to accept a baby bottle nipple mounted therethrough.

The child-resistant closure may also cover a child's sipping cup, wherein inner screw cap is threadably mountable on the sipping cup.

Optionally, the child resistant closure may also be closed by a user-removable sanitary protection cap, which is removably mounted by a suitable mount on the outer operating ring cap. This sanitary cap has sufficient height and volume therewithin to accommodate the mounted-in-place baby bottle nipple in a sanitary protection therein.

The child resistant closure may also be a user-removable sanitary protection cap, removably mounted by the suitable mount on the outer operating ring cap, wherein the sanitary cap has sufficient height and volume therewithin, to accommodate the drinking-spout on the sipping cup.

The removable sanitary protection cap of the child resistant closure is mounted by mated fluted surfaces which are located both on an underside of the sanitary protection cap and on the surface of the outer operating ring cap, at the points of contact therebetween. This permits the sanitary protection cap to transmit torque bi-directionally to the outer operating ring cap upon the baby bottle or upon the sipping cup.

As a result, both the nippled baby bottle and the child's sipping cup are conveniently closed so that a toddler or small child cannot remove the cap and spill the contents therefrom.

BRIEF DESCRIPTION OF THE DRAWINGS

The present invention can best be understood in connection with the accompanying drawings, in which:

FIG. 1 is a perspective view of a baby bottle using the child-proof closure cap of this invention;

FIG. 2 is a perspective view of a sipping cup using the child-proof closure cap of this invention;

FIG. 3 is a side elevational view in cross section of an embodiment for a two-part baby bottle cap;

DETAILED DESCRIPTION OF THE INVENTION

Figure 4:
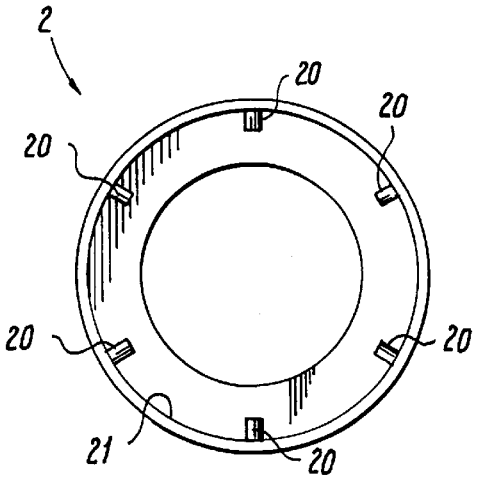
FIG. 4 is a bottom view of the operating ring of the present invention.

In keeping with the objective of creating a child resistant cap for baby bottles and toddler sipping cups, a "push down while turning" collar has been added to the conventional caps of these containers. This should make it very difficult for a baby (or his older siblings) to loosen the cap on a baby bottle and for a toddler or small child to loosen the cap of a sipping cup.

FIG. 1 shows a baby bottle 1 of this invention with container housing 5, nipple 4, screw cap 3, and operating collar 2 which can spin freely in the loosening direction unless it is pushed down firmly.

In FIG. 2, a sipping cup 10 is shown with cup housing 14, screw cap 13 with sipping spout 12, and operating collar 11 which functions similarly to that on baby bottle 1. The operating details are discussed using the configuration for baby bottle 1, however the details are similar for sipping cup 10.

The cross section view of FIG. 3 shows the two part cap, including of the operating ring 2, which is snapped over the screw cap 3 by the manufacturer, so that the consumer receives an assembly of the two parts. This can be sold as an aftermarket substitute for the baby bottle cap originally supplied by the bottle manufacturer.

Since no modification of the bottle threads is necessary, in the foregoing embodiment, such a device can be easily designed to mate with standard threads used by a number of manufacturers of popular brands of baby bottles.

Figure 5:
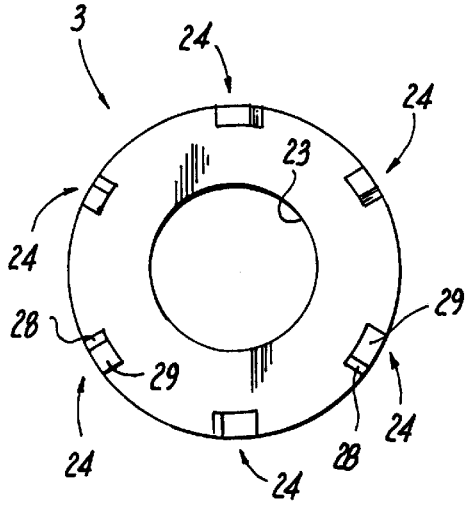
FIG. 5 is a top plan view of the screw cap of the present invention.

FIG. 3 further shows that operating ring 2 has radial nibs 20 on the inside top surface and a retaining rim 21 at its inside lower edge. As shown in FIGS. 4 and 5, screw cap 3 with molded threads 25 and nipple opening 23 has protrusions 24 molded onto its top surface. Several key dimensions are shown in FIG. 3. These are necessary for proper operation. Height dimension "A" is measured from the bottom of nib 20 to the top of rim 21. Dimension "D" is the overall height of screw cap 3, including the height of protrusions 24.

To insure that operating ring 2 can freely rotate in the "unscrew" direction, dimension "A" is greater than dimension "D" Similarly, the inside surface of operating ring 2, "B", must be larger than the outside surface of screw cap 3, designed by "E". Also, the inside diameter "C" of rim 21, must be slightly smaller than "E" so as to facilitate both snap-over and then retention of screw cap 3 within operating ring 2.

FIG. 4 shows the radial nibs 20 in a symmetric pattern on the underside of operating ring 2.

FIG. 5 shows protrusions 24 in a similar symmetric pattern on the top of screw cap 3. Each includes a ramp section 28 at one end and a step portion 29 at the other end. In FIGS. 4 and 5, only six engaging members are shown for clarity of illustration. A manufactured assembly could have many more symmetrically arranged elements for smoother operation.

Figure 6:
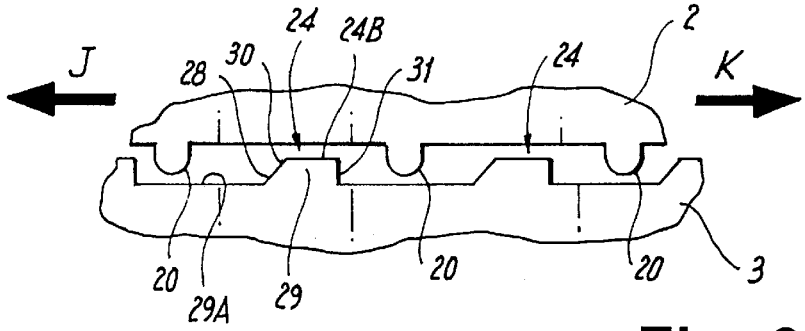
FIG. 6 is a side elevational view of the present invention, showing the engagement detail.

The essential mating pattern of nibs 20 with protrusions 24 is illustrated in a schematic fashion in the side elevational view of FIG. 6. As ring 2 is moved in the left J direction relative to cap 3, steps 29 engages the straight sides of nibs 20, thereby very little downward pressure is required to maintain engagement, while transmitting significant closing torque to cap 3.

However, when ring 2 is moved to the right K direction, nibs 20 encounter ramps 28 which tend to disengage the two members. This requires significant downward force on ring 2 to permit transmission of a significant unscrewing torque on cap 3.

For example, the child resistant closure includes an inner screw cap 3 threadably mountable on a container and an outer operating ring cap 2 mounted on the inner cap 3, wherein the outer operating ring cap 2 has a circumferential retaining rim 21 on a lower end thereof. The retaining rim 21 retains the inner cap 3 within outer operating ring cap 2. Outer operating ring cap 2 includes a plurality of downwardly-projecting nibs 20 disposed on an inside top surface thereof. Reciprocally, inner screw cap 3 has a circumferential engagement ring 24 on an upper surface of screw cap 3. The engagement ring 24 has a top surface 29 and plurality of radially disposed ramped notches 28 therein, wherein notches 28 each respectively have a depressed floor 29A, a vertical boundary wall 31 running between floor 29A and top surface 29 on one side of notch 28 and a ramp 30 running between floor 29A and top surface 29 on another side of notch 28.

Nibs 20 engage ramped notches 28 in ratchet fashion to permit tightening of inner screw cap 3 when nibs 20 engage vertical boundary wall 31 when outer operating ring cap 2 is rotating in the screw-on direction.

Nibs 20 engage ramped notches 28 in ratchet fashion to permit free rotation of outer operating ring cap 2 in the screw-off direction about inner screw cap 3 when nibs 20 engage ramp 30 without user compressive force. Nibs 20 engage ramps 30 to permit effective screw-off torque contact between nibs 20 of outer operating ring cap 2 and ramps 30 of inner screw cap 3, when adult-user compressive force is applied to outer operating ring cap 2 while turning in the screw-off direction. The simultaneous compressive force and screw-off turning effects screw-off loosening of inner screw cap 3 from threaded engagement on a container.

Circumferential retaining rim 21 grasps inner screw cap 3 upon adult-user application of upward force while turning in the screw-off direction subsequent to screw-off loosening of inner screw cap 3, wherein grasping of loosened inner screw cap 3 by retaining rim 21 provides for relatively effortless and convenient adult-user unscrewing of inner screw cap 3.

Preferably, said inner screw cap 3 is threadably mountable on containers such as standard-thread baby bottles, such as baby bottle 1, and in that case inner screw cap 3 has a central aperture to accept a baby bottle nipple mounted therethrough.

With a baby bottle, inner screw cap 3 is threadably mountable on the baby bottle.

The child resistant closure preferably further a user-removable sanitary protection cap 32 removably mounted by a suitable mount on outer operating ring cap 2, wherein the sanitary cap 32 has sufficient height and volume therewithin to accommodate a mounted-in-place baby bottle nipple in sanitary protection.

The mount of removable sanitary protection cap 32 preferably includes mated fluted surfaces disposed both on an underside of sanitary protection cap 32 and on the surface of outer operating ring cap 2 at the points of contact therebetween, so as to permit sanitary protection cap 32 to transmit torque bi-directionally to outer operating ring cap 2.

The mount of the removable sanitary protection cap may include mated fluted surfaces disposed both on an underside of sanitary protection cap 32 and on the surface of outer operating ring cap 2 at the points of contact therebetween so as to permit sanitary protection cap 32 to transmit torque bi-directionally to outer operating ring cap 2.

Alternatively, the said container may be a child's sipping cup 10, wherein inner screw cap 3 is threadably mountable on sipping cup 10. A user-removable sanitary protection cap 36 is removably mounted by suitable mounting means on outer operating ring cap 11. Sanitary cap 36 has sufficient height and volume therewithin to accommodate the drinking-spout 12 of sipping cup 10. The sanitary protection cup 36 of the child resistant closure for a sipping cup includes mated fluted surfaces disposed both on an underside of sanitary protection cap 36 and on the surface of outer operating ring cap 11 at the points of contact therebetween so as to permit said sanitary protection cap 36 to transmit torque bi-directionally to said outer operating ring cap 11.

Thus for opening either baby bottle 1 or sipping cup 10, operating rings 2 or 11 respectively must be manually pushed down with reasonable force to unscrew caps 3 or 13 respectively. In the case of baby bottle 1, however, the high frictional coefficient of nipple 4 against screw cap 3 and housing 5 alters the operation and design slightly. For example, as ring 3 is forced down while unscrewing cap 3, a significant frictional counter-torque is generated proportional to the downward force, which further impedes rotation. This effect should be taken into account in the selection of the angles of ramp 28, since too shallow an angle makes the operation too difficult.

Before use the consumer is instructed to loosen the cap only a fraction of a turn while pressing down. Then, ring 2 is pulled up while turning thereby separating nipple 4 from housing 5 thus making the rest of the unscrewing operation quite effortless.

Figure 7:
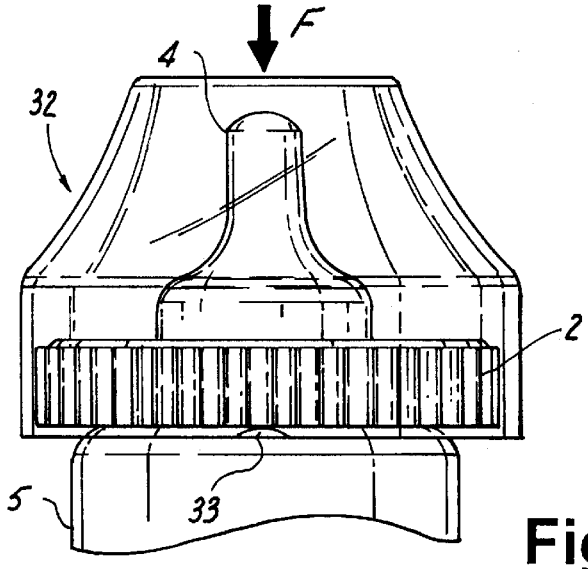
FIG. 7 is a side elevational view in partial cut-away of the baby bottle with a transparent over-cap.

In an alternate embodiment, as shown in FIG. 7, an over-cap 32 is snapped onto operating ring 2 and retained by a pattern of three or more tabs 33 on the inside rim of over-cap 32. The illustration of FIG. 7 shows a transparent over-cap 32.

Figure 8:
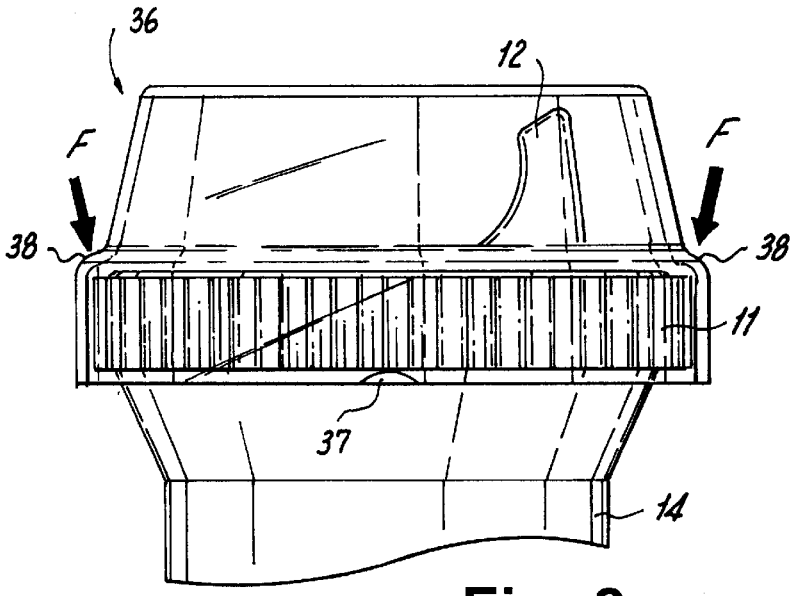
FIG. 8 is a side elevational in partial cross section of the sipping cup with a transparent over-cap.

Similarly, FIG. 8 shows an alternate embodiment of the sipping cup 10 which includes a transparent over-cap 36, which snaps over operating ring 11 and is retained by a pattern of three or more tabs 37 or slight protrusions on the inside rim.

Figure 9:
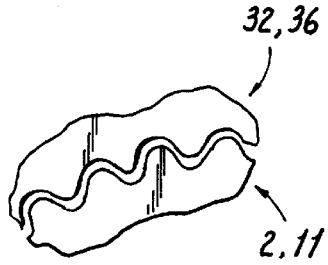
FIG. 9 is a bottom detail view of a fluted edge engagement of the operating ring with an over-cap.

FIG. 9 shows an underside detail of mating fluted edges of overcaps 32 or 36 and operating rings 2 or 11 respectively. With this edge design, the over-caps 32 or 36 can transmit torque bi-directionally to operating rings 2 or 11 respectively.

Furthermore as shown in FIG. 7 the shape of over-cap 32 can transmit downward force to operating ring 2.

Also, in FIG. 8, corner 38 on over-cap 36 permits downward force transmission to operating ring 11. Therefore, either over-cap 32 or overcap 36 can remain in place while opening either baby bottle 1 or sipping cup 10 respectively.

Figure 10:
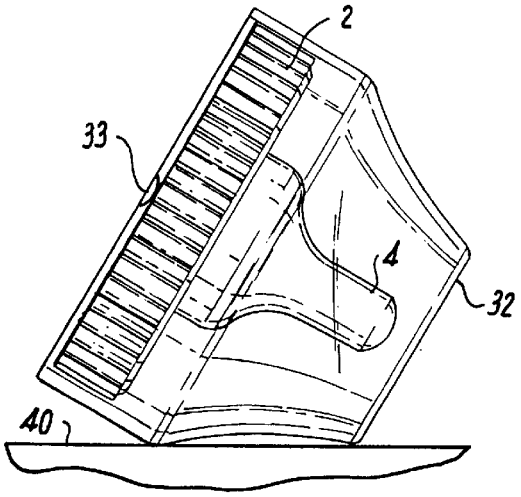
FIG. 10 is a side elevational view of a baby bottle cap with a sanitary cover, shown on horizontal surface; and, FIG. 11 is a side elevational view of a sipping cup cap with a sanitary cover, shown on horizontal surface.
Figure 11:
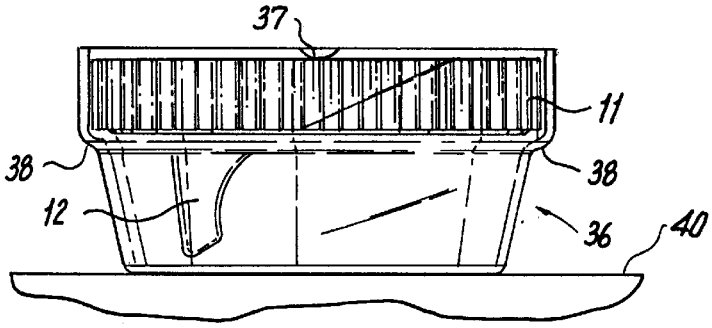

As further shown in FIGS. 10 and 11, the entire cap with an over-cap can be removed as a unit and placed on a horizontal surface 40 (such as a table-top) without contaminating the mouth or lip contact areas. Therefore, two hands can be more conveniently used for filling either baby bottle 1 or sipping cup 10.

It is further noted that other modifications may be made to the present invention, without departing from the scope of the invention, as noted in the appended Claims.

We claim:

1. A child resistant closure comprising:

(a) an inner screw cap 3 threadably mountable on a container;

(b) an outer operating ring cap 2 mounted on said inner cap 3, said outer operating ring cap 2 having a circumferential retaining rim 21 on a lower end thereof: said retaining rim 21 for retaining said inner cap within said outer cap;

(c) said outer operating ring cap 2 having a plurality of downwardly-projecting nibs 20 disposed on an inside top surface thereof;

(d) said inner screw cap 3 having a circumferential engagement ring 24 on an upper surface of said screw cap 3; said engagement ring 24 having a top surface 29 and plurality of radially disposed ramped notches 28 therein; said notches 28 each respectively comprising a depressed floor 29A, a vertical boundary wall 31 running between said floor 29A and said top surface 29 on one side of said notch 28 and a ramp 30 running between said floor 29A and said top surface 29 on another side of said notch 28;

(e) said nibs 20 for engaging ramped notches 28 in ratchet fashion to permit tightening of inner screw cap 3 when nibs 20 engage vertical boundary wall 31 when outer operating ring cap 2 is rotating in the screw-on direction; and (f) said nibs 20 for engaging ramped notches 28 in ratchet fashion to permit free rotation of outer operating ring cap 2 in the screw-off direction about inner screw cap 3 when nibs 20 engage ramp 30 without user compressive force; and (g) said nibs 20 for engaging ramps 30 to permit effective screw-off torque contact between said nibs 20 of said outer operating ring cap 2 and said ramps 30 of said inner screw cap 3 when adult-user compressive force is applied to outer operating ring cap 2 while turning in the screw-off direction; said simultaneous compressive force and screw-off turning effecting screw-off loosening of said inner screw cap 3 from threaded engagement on a container;

(h) said circumferential retaining rim 21 grasping inner screw cap 3 upon adult-user application of upward force while turning in the screw-off direction subsequent to screw-off loosening of said inner screw cap 3; said grasping of loosened inner screw cap 3 by retaining rim 21 providing for relatively effortless and convenient adult-user unscrewing of inner screw cap 3, wherein i. said inner screw cap 3 is threadably mountable on containers comprising standard-thread baby bottles;

j. said inner screw cap 3 has a central aperture to accept a baby bottle nipple mounted therethrough.

2. The child resistant closure of claim 1; further comprising a. a baby bottle; said inner screw cap 3 being threadably mountable on said baby bottle.

3. The child resistant closure of claim 2, further comprising a. a user-removable sanitary protection cap removably mounted by suitable mounting means on said outer operating ring cap 2; said sanitary cap having sufficient height and volume therewithin to accommodate a mounted-in-place baby bottle nipple in sanitary protection.

4. The child resistant closure of claim 3, wherein a. said suitable mounting means of said removable sanitary protection cap comprises mated fluted surfaces disposed both on an underside of said sanitary protection cap and on the surface of said outer operating ring cap 2 at the points of contact therebetween so as to permit said sanitary protection cap to transmit torque bi-directionally to said outer operating ring cap 2.

5. A child-resistant closure, comprising:

(a) an inner screw cap 3 threadably mountable on a container;

(b) an outer operating ring cap 2 mounted on said inner cap 3, said outer operating ring cap 2 having a circumferential retaining rim 21 on a lower end thereof; said retaining rim 21 for retaining said inner cap within said outer cap;

(c) said outer operating ring cap 2 having a plurality of downwardly-projecting nibs 20 disposed on an inside top surface thereof;

(d) said inner screw cap 3 having a circumferential engagement ring 24 on an upper surface of said screw cap 3; said engagement ring 24 having a top surface 29 and plurality of radially disposed ramped notches 28 therein; said notches 28 each respectively comprising a depressed floor 29A, a vertical boundary wall 31 running between said floor 29A and said top surface 29 on one side of said notch 28 and a ramp 30 running between said floor 29A and said top surface 29 on another side of said notch 28:

(e) said nibs 20 for engaging ramped notches 28 in ratchet fashion to permit tightening of inner screw cap 3 when nibs 20 engage vertical boundary wall 31 when outer operating ring cap 2 is rotating in the screw-on direction; and (f) said nibs 20 for engaging ramped notches 28 in ratchet fashion to permit free rotation of outer operating ring cap 2 in the screw-off direction about inner screw cap 3 when nibs 20 engage ramp 30 without substantial user compressive force; and (g) said nibs 20 for engaging ramps 30 to permit effective screw-off torque contact between said nibs 20 of said outer operating ring cap 2 and said ramps 30 of said inner screw cap 3 when sufficient adult-user compressive force is applied to outer operating ring cap 2 while turning in the screw-off direction; said simultaneous compressive force and screw-off turning effecting screw-off loosening of said inner screw cap 3 from threaded engagement on a container;

(h) said circumferential retaining rim 21 grasping inner screw cap 3 upon adult-user application of upward force while turning in the screw-off direction subsequent to screw-off loosening of said inner screw cap 3; said grasping of loosened inner screw cap 3 by retaining rim 21 providing for relatively effortless and convenient adult-user unscrewing of inner screw cap 3, (i) said container being a child's sipping cup, said inner screw cap 3 being threadably mountable on said sipping cup, and, (j) a userrernovable sanitary protection cap removably mounted by suitable mounting means on said outer operating ring cap 2; said sanitary cap having sufficient height and volume therewithin to accommodate drinking-spout means on said sipping cup.

6. The child resistant closure of claim 5, a. said suitable mounting means of said removable sanitary protection cap comprises mated fluted surfaces disposed both on an underside of said sanitary protection cap and on the surface of said outer operating ring cap 2 at the points of contact therebetween so as to permit said sanitary protection cap to transmit torque bi-directionally to said outer operating ring cap 2.

* * * * *